United States Patent [19]

Annovi

[11] 4,227,322

[45] Oct. 14, 1980

[54] SPORT FOOTWEAR OF INJECTED PLASTICS MATERIAL

[75] Inventor: Giuseppe Annovi, Montebelluna, Italy

[73] Assignee: Dolomite, S.p.A., Treviso, Italy

[21] Appl. No.: 950,999

[22] Filed: Oct. 13, 1978

[51] Int. Cl.[2] ..... A43B 5/04; A43B 11/00

[52] U.S. Cl. ..... 36/117; 36/50

[58] Field of Search ..... 36/117, 118, 119, 120, 36/121, 50

[56] References Cited

U.S. PATENT DOCUMENTS

| | | | |
|---|---|---|---|
| 3,834,048 | 9/1974 | Maurer | 36/50 |
| 4,095,354 | 6/1978 | Annori | 36/50 |

FOREIGN PATENT DOCUMENTS

| | | | |
|---|---|---|---|
| 1808115 | 11/1968 | Fed. Rep. of Germany | 36/117 |

*Primary Examiner*—Patrick D. Lawson

*Attorney, Agent, or Firm*—D. Paul Weaver

[57] ABSTRACT

Sporting footwear, such as a mountain boot or hockey boot or training boot, formed of injected plastics, has integral lacing projections formed on overlapping front closure flaps forming parts of the boot upper. The integral projections provide for easy zigzag lacing of the boot with security and economy of manufacturing. Protrusions integrally formed on the boot upper between adjacent pairs of lacing projections and spaced from the projections bear frictionally on the lace engaged with the integral projections. Tightening of the lace is enhanced while the lace is under tension and loosening of the lace is hindered when the lace is slackened and has its cross section increased.

7 Claims, 4 Drawing Figures

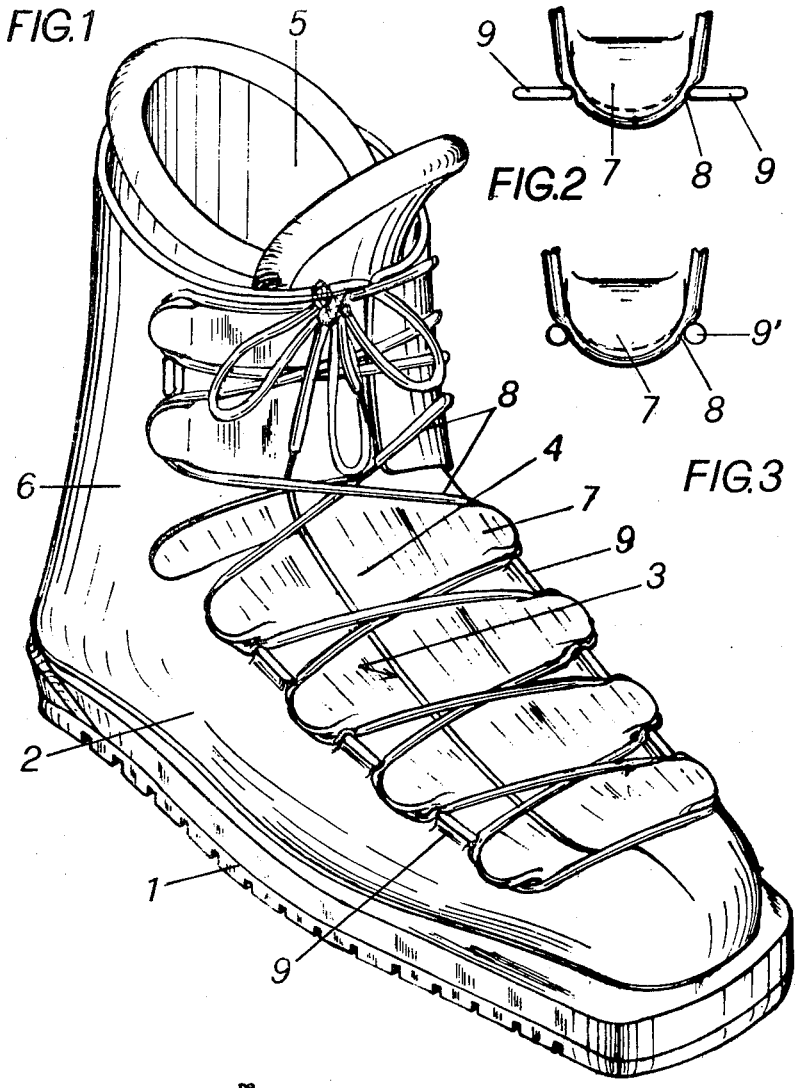
FIG.2
FIG.3
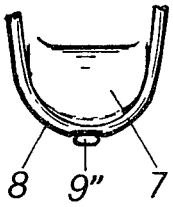
FIG.4

SPORT FOOTWEAR OF INJECTED PLASTICS MATERIAL

BACKGROUND OF THE INVENTION

Sporting footwear formed by injection molding of plastics material is known in the prior art. Such molded plastics footwear can comprise an upper provided with a non-slip sole, a front opening defined by two overlapping flaps and usually a tongue located adjacent to the flaps. On the two flaps, rings, eyelets or hooks are commonly applied to receive the traditional cross lacing which binds the foot-wear to the wearer's foot snugly.

A drawback of such known footwear is that the attached lacing elements, eyelets or hooks, are generally made of metal, requiring additional costly time-consuming manufacturing steps, which weigh heavily on the final cost of the product. In boots, the front closure flaps are long requiring a greater number of metal eyelets or hooks, thus further increasing cost.

Another drawback of the prior art footwear is that the threading of laces through eyelets or rings is an inconvenient, time-consuming operation, whereas if hooks are provided it is much easier to engage them with laces, but undesirably there may be a quick separation of the laces from the hooks every time the footwear is undone or loosened.

Therefore, an object of the invention is to provide sporting footwear of injected plastics, for example, mountain, hockey or training boots having a more convenient lacing arrangement which is easier to manufacture and of much lower cost compared to the above-discussed prior art.

Another object is to provide footwear of the above-mentioned class which possesses the known advantages of lacing eyelets and hooks while at the same time eliminating their known deficiencies.

A further object is to realize sporting footwear possessing auto-blocking lacing, that is, lacing which does not loosen when the wearer's stretching of the lace ceases.

The above aims of the invention are achieved in sporting footwear made of injected plastics having a front opening including closure flaps provided with integral means to engage crossed lacing, wherein the means consists of projections formed of the same plastics material from which the upper and closure flaps are formed.

Further, in accordance with the invention, lace engaging means associated with the integral projections hinder reverse sliding of the lace relative to the projections, at least when the lace is slackened.

Advantageously, each lacing projection is roughly semi-circular or mushroom-sahped to conveniently engage the lace under a lip thereof. Coacting with each lacing projection is at least one protrusion formed from the same plastics used to mold the upper, and said protrusion being at a distance from the lacing projection somewhat less than the cross sectional thickness of the lace, at least when the lace is slackened.

The features and advantages of the invention will become more clearly apparent in the course of the following description, which is to be read with reference to the accompanying drawings.

BRIEF DESCRIPTION OF THE DRAWINGS

FIG. 1 is a perspective view of footwear according to the invention.

FIG. 2 is an enlarged fragmentary plan view of a lacing projection and coacting protrusions which exert pressure on the lacing at least when it is slackened.

FIG. 3 is a similar plan view showing a modified arrangement of protrusions.

FIG. 4 is a similar plan view showing a further modification of the invention.

DETAILED DESCRIPTION

Referring to the drawings in detail where like numerals designate like parts, the injection molded plastic footwear, such as a sports boot, may be formed from polyurethane or the like. The footwear sole 1 can be made of rubber and glued to the upper 2 after the latter is molded; or the sole may be placed in the mold before the injection, so as to come out of the mold after the injection attached to the upper. The sole can also be made integral with the upper by molding from the same plastics used to produce the upper.

The upper 2 of the footwear or boot includes a front opening 3 formed by two overlapping flaps integral with the upper. Inside of the upper 2 is a mobile thick walled soft inner shoe 5, the thickened border of which extends somewhat above the upper portion 6.

The closure flaps 4 of front opening 3 include a plurality of integral lacing projections 7 molded simultaneously with the upper in the manufacturing of the product.

The projections 7 are roughly semi-circular or mushroom-shaped in plan to allow easy and quick engagement with a lace 8 running in a zigzag path back and forth between opposing projections 7 of the overlapping flaps 4. When engaging each lacing projection 7, the lace 8 enters beneath a top lip or ledge of the projection as illustrated.

In the embodiment shown in FIGS. 1 and 2, between each pair of contiguous projections 7, there are provided bar-like protrusions 9, integrally molded with the upper, to delimit, togethere with the body of each projection 7, a passage for the lace 8. As best shown in FIGS. 2 and 3, the width of each such passage is less than the cross sectional thickness of the lace 8 when the lace is slackened, but wider than the lace thickness when the lace is stretched taut. In effect, the lace 8 when slackened is squeezed between the projection 7 and the adjacent elements 9 and is frictionally held.

With the same efficiency, the protrusions 9 of FIG. 2 may be replaced by cylindrical or part-cylindrical pegs 9', located laterally of the projections 7, FIG. 3, or located centrally of the projection, as indicated in FIG. 4, showing a single peg element 9''.

In each case, each protrusion 9, 9' and 9'' is separated from the respective lacing projection 7 to allow the insertion by finger pressure of the lace 8 between the protrusion and the lacing projection 7.

The footwear according to the invention is operated in the following manner. Initially, the lace 8 is introduced between each projection 7 and the cooperating protrusion 9, 9' or 9'', thus setting up the traditional crossed lacing arrangement shown in FIG. 1. After insertion of the wearer's foot into the footwear, the two flaps 4 are brought together in overlapping relationship to obtain the desired degree of fastening.

During such operation, the lace 8 is stretched, and its cross sectional thickness becomes less or thinner, and the lace will easily slide relative to the projections 7, and will bring about the proper fastening effect of the footwear. On the other hand, when the lace is slackened, its cross section increases, thus hindering the sliding of the lace in a contrary or loosening direction relative to the projections 7. Thus, the fastening of the footwear becomes substantially irreversible. This effect is amplified by the fact that, when the lace is slackened, the friction between the lace and all projections 7 and coacting protrusions 9, 9' or 9'' are added or cumulative in their holding effect. Under such conditions, slackening of the footwear fastening becomes highly improbable.

It is obvious that the width of the passage delimited by each protrusion 9, 9', 9'' and the relative projection 7 may even be lower than the cross section of lace 8, when the latter is stretched. In such a case, the fastening of the footwear is even more steady, but the sliding of the lace between the projection and the protrusion and thin pegs may become less easy, even during the fastening of the footwear.

From what has been said, it clearly appears that the footwear according to the present invention, offers the following advantages:

(a) The footwear is of simple manufacturing, with consequent lower cost.

(b) The footwear allows quick lacing.

(c) The lace cannot disengage, even when the footwear is undone.

(d) The fastening of the footwear is an easy, practically irreversible operation.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. Sporting footwear, such as mountain footwear, hockey or training footwear, comprising an upper of injected plastics material having a front opening formed by a pair of flaps, projection means integrally formed on the flaps from the same injected plastics material and being engageable with crossed lacing operable to hold the front opening of the footwear closed, and separate protrusion means integrally formed on the flaps from the same injected plastics material near the projection means and coacting with the projection means to hinder sliding of the lace relative to the projection means when the lace is engaged between the projection and protrusion means at least when the lace is slackened.

2. Sporting footwear as defined in claim 1, and said protrusion means comprising a bar-like protrusion extending between each contiguous pair of projections of said projection means along each flap.

3. Sporting footwear as defined in claim 1, wherein said projection means comprises plural spaced projections along each flap, each projection being generally mushroom-shaped, said protrusion means comprising at least a single protrusion adjacent to each projection and spaced therefrom a distance less than the cross section of the lace at least when the lace is slackened.

4. Sporting footwear as defined in claim 3, and said protrusion means comprising a single upstanding peg-like element adjacent to the crown of each mushroom-shaped projection.

5. Sporting footwear as defined in claim 1, and said protrusion means comprising a pair of upstanding peg-like elements near opposite sides of each projection of the projection means along said flaps.

6. Sporting footwear formed of injection molded plastics material including an upper having a front opening formed by a pair of flaps, projection means integrally formed on the flaps from the same plastics material from which the flaps are formed and being engageable with crossed lacing operable to hold the front opening of the footwear closed, and separate protrusion means formed integrally on said flaps near the projection means from the same plastics material from which the flaps are formed and coacting with the projection means to hinder sliding of the lacing relative to the projection means when the lacing is engaged between the projection and protrusion means at least when the lacing is slackened, said projection means comprising plural spaced generally mushroom-shaped projections along each flap, and said protrusion means comprising at least a single protrusion adjacent to each projection and spaced therefrom a distance less than the cross section of the lacing at least when the lacing is slackened, and each protrusion being arranged so that it is common to two contiguous projections along each flap.

7. Sporting footwear as defined in claim 6, and said protrusion means comprising a bar-like protrusion extending between each contiguous pair of projections along each flap.

* * * * *